US007604051B2

(12) United States Patent
Pinchin

(10) Patent No.: US 7,604,051 B2
(45) Date of Patent: Oct. 20, 2009

(54) METHOD AND DEVICE FOR SEPARATION OF PARTICLES FROM INJECTION WATER

(75) Inventor: David Pinchin, Hundvåg (NO)

(73) Assignee: Well Processing AS (NO)

( * ) Notice: Subject to any disclaimer, the term of this patent is extended or adjusted under 35 U.S.C. 154(b) by 0 days.

(21) Appl. No.: 12/067,205

(22) PCT Filed: Sep. 11, 2006

(86) PCT No.: PCT/NO2006/000311

§ 371 (c)(1),
(2), (4) Date: Mar. 18, 2008

(87) PCT Pub. No.: WO2007/035106

PCT Pub. Date: Mar. 29, 2007

(65) Prior Publication Data

US 2008/0257550 A1 Oct. 23, 2008

(30) Foreign Application Priority Data

Sep. 22, 2005 (NO) ..... 20054387

(51) Int. Cl.
*E21B 43/40* (2006.01)

(52) U.S. Cl. ..... 166/266; 166/90.1; 166/75.12; 166/267

(58) Field of Classification Search ..... None
See application file for complete search history.

(56) References Cited

FOREIGN PATENT DOCUMENTS

| | | | |
|---|---|---|---|
| EP | 0201263 | A1 | 12/1986 |
| GB | 2067234 | A | 7/1981 |
| GB | 2246123 | A | 1/1992 |

*Primary Examiner*—Zakiya W. Bates
(74) *Attorney, Agent, or Firm*—Akerman Senterfitt

(57) ABSTRACT

A method and device for separating particles from injection water, the injection water being used for the stimulation of a petroleum reservoir. The water is drawn from a water reservoir, cleaned and typically treated by means of additives before being led into the petroleum reservoir. The injection water is first led into a closed space (14), in which the flow rate is sufficiently low for undesired particles to precipitate from the injection water.

12 Claims, 1 Drawing Sheet

METHOD AND DEVICE FOR SEPARATION OF PARTICLES FROM INJECTION WATER

Figure 1:
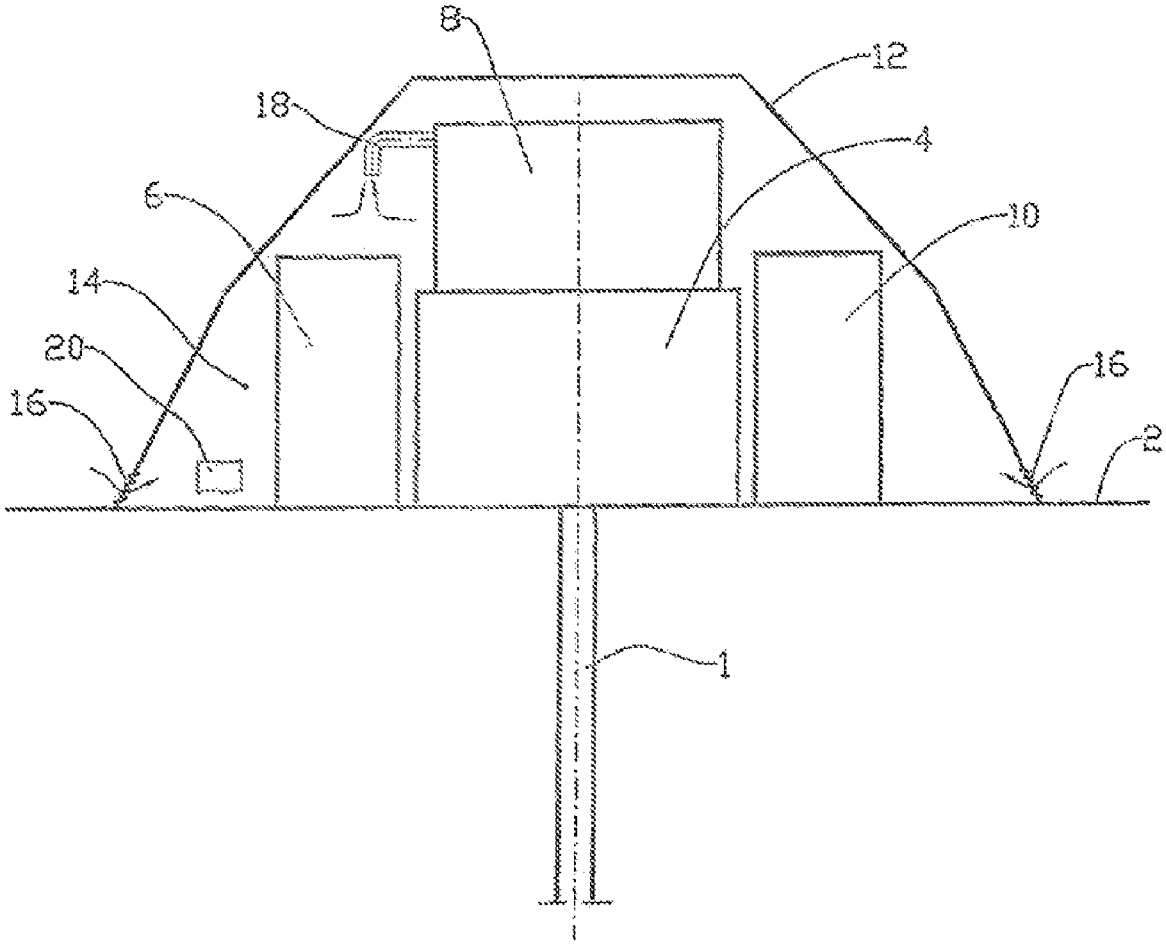

This invention relates to a method for separating particles from injection water. More particularly it relates to a method for separating particles from untreated water, which is to be used for stimulating a petroleum reservoir. The injection water which is drawn from a water reservoir, is cleaned by leading the injection water into a closed space, in which the flow rate is sufficiently low for particles above a certain size and specific gravity to precipitate from the injection water, after which it is typically treated by means of additives before being led into the petroleum reservoir. The invention also comprises a device for practicing the method.

By a closed space is meant in this connection a space, which is essentially shut off from the surroundings to provide a controlled flow.

In the description the term "water" is used about injection water, which is termed untreated waters in its raw form. If reference is made to other water, this is specially noted.

One of the methods that are used to increase the recovery rate from a petroleum reservoir is the pumping of so-called injection water into the petroleum reservoir. The injection water makes an increased portion of petroleum be driven out of the petroleum reservoir.

As injection water may be used so-called produced water, which is separated from produced petroleum, or untreated water may be used, for example seawater. Before the injection water is led into a reservoir it is necessary, particularly when untreated water is used, to treat the water both mechanically, to remove undesired particles from the injection is water, and chemically, to prevent unintended effects of the water in the reservoir. Such unintended effects could be, for example, bacterial growth and corrosion.

In accordance with the prior art the removal of undesired particles is often carried out by means of mechanical filtration. Due to the flow rates involved, filtering plants for filtering injection water are relatively large and costly.

While plants for treating injection water were earlier placed on shore, possibly on floating or fixed installations off shore, the development has gone, as far as the recovery off shore is concerned, in the direction of placing prior art plants on the seabed, for example at a well head.

It is obvious that the operation and maintenance of relatively large injection water filters installed on the seabed are relatively complicated and expensive.

The invention has as its object to remedy or reduce at least one of the drawbacks of the prior art.

The object is achieved in accordance with the invention through the features specified in the description below and in the subsequent claims.

Before untreated injection water, which is to be used for stimulating a petroleum reservoir, can be led into the petroleum reservoir, the injection water must be cleaned, preferably before it is possibly treated by means of additives. According to the invention the normally untreated water is led into a closed space, in which the flow rate is sufficiently is low for undesired particles that are present in the water, to precipitate from the water.

It is advantageous that, while within the space, the injection water is led to flow from a lower level of height to a higher level of height.

The space, which may with advantage be located on the seabed, is typically provided with inflow openings at its lower portion. Alternatively, an inflow pipe may carry the water to be treated to the lower portion of the space.

The water then flows at a relatively low rate upwards from the lower portion of the space, the flow rate being so low that the undesired particles precipitate from the water.

To describe theoretically a process of precipitation of a material in a fluid, it is common to take as a basis the generally known Stoke's law:

$$V_t = \frac{g \cdot D^2 \cdot (\rho_1 - \rho_2)}{18 \cdot \mu} \left[\frac{m}{s}\right]$$

For particles in water, $V_t$ is the precipitation velocity of a particle in the water, g is gravitation, D is the particle diameter, $\rho_1$ is the specific gravity of the particle, $\rho_2$ is the specific gravity of a continuous phase (water), and $\mu$ is the viscosity of the continuous phase.

Thus, when the largest acceptable diameter and specific weight of particles that may be entrained in the injection water to the petroleum reservoir, have been determined, it is relatively easy to determine the precipitation velocity of the smallest particles that have to be precipitated. The climbing is speed within the space must be lower than the precipitation velocity of the smallest particles that have to be precipitated.

The untreated water may contain organic particles of a specific weight equal to or lower than that of water, and living organisms, which are capable of floating about in the space and therefore cannot be precipitated from the water. Thus, it may be appropriate to let at least part of the untreated water, before it flows into the space or while it is in the space, be led into contact with, for example, copper or other substances which have a repelling effect on organisms of this kind. The aim is to make the space as little attractive as possible to undesired organisms.

In a practical embodiment the space may be comprised of a superstructure enclosing a wellhead on the seabed. Besides well head valves there may be, in the space, apparatuses for further treatment of the injection water and also pumps and other equipment in accordance with the prior art known per se. The space may possibly be formed by a separate structure arranged for the purpose.

It is advantageous that the injection water is taken from the space at the upper portion of the space, from where the injection water is typically carried to subsequent further treatment.

The use of the method according to the invention essentially renders filtration of injection water superfluous. This enables a significant simplification of the injection water treatment plants, which is particularly advantageous when such plants are located on the seabed.

In what follows is described a non-limiting example of a preferred method and embodiment visualized in the accompanying drawing, in which:

FIG. 1 shows schematically and in section a space according to the invention, arrows indicating the flow of the water.

In the drawing the reference numeral 1 identifies a pipe connection extending from the seabed 2 down to a petroleum reservoir, not shown, in the ground.

A wellhead 4 is placed on the seabed 2 and is connected to the pipe connection 1.

Surrounding the wellhead 4, and above it, are arranged at least one water treatment apparatus 6, a pump module 8 and an energy and control module 10. Other necessary equipment packages, not shown, in accordance with the prior art known per se are also placed at the wellhead 4.

Said apparatuses and modules 4 to 10 and also equipment packages, not shown, are surrounded by plate-shaped covers 12 forming together with the seabed 2 a closed space 14. The covers 12 may include hatches, not shown, for access to the space 14.

At the lower portion of the space 14 are arranged openings 16 where untreated water from the surroundings may enter. The water then flows upwards in the space 14 at a flow velocity, which, due to the cross-sectional area of the space, is lower than the precipitation velocity of the smallest particle which is desirably to be precipitated from the water. The particles in the water are not shown in the FIGURE. The precipitated particles, not shown, settle on the seabed 2 and on apparatus parts 4, 8, 10, from which, if necessary, they may be flushed away whenever necessary.

After the water has flowed upwards to the upper portion of the space 14 and has become essentially free of undesired particles, the water enters the inlet opening of a pump pipe 18, from where the water flows via the pump module 8 and water treatment apparatus 6 through the pipe connection I to the petroleum reservoir, not shown.

In the space 14 there is placed copper 20 or other organism-repellent or toxic material, for example in the form, of a copper-containing material which is in contact with at least part of the water flowing through the space 14. The purpose of the copper 20 is to make the space less attractive to living organisms.

In a further exemplary embodiment, not shone, a channel for the inflow of water into the space 14 may open into the lower portion of the space 14.

The invention claimed is:

1. A method for removing, without filtering, undesired particles from untreated water, to be used for injection and stimulation of a petroleum reservoir, the method comprising the steps of:

drawing the untreated water from a water reservoir;

leading the untreated water directly into a lower portion of a closed space;

leading the water from the lower portion to an upper portion of the closed space whilst flowing at a flow velocity sufficiently low for allowing undesired particles in the water to precipitate by means of gravitation; and leading cleaned water out of the upper portion of the closed space and into the petroleum reservoir.

2. The method in accordance with claim 1, further comprising leading at least a part of the water, in the closed space into contact with an organism-repellent or toxic material for repelling, impairing or destroying undesired organisms in the water.

3. The method in accordance with claim 1, further comprising drawing untreated water from a body of water surrounding the enclosed space.

4. A device for removing, without filtering, undesired particles from untreated water, to be used for injection and stimulation of a petroleum reservoir, wherein the untreated water is drawn from a water reservoir and is led into the device for removal of said particles, after which cleaned water is led into the petroleum reservoir, said device comprising:

a closed space having a lower portion into which the untreated water is led directly;

an upper portion from which the cleaned water is discharged; and a cross-sectional area arranged in a manner allowing the water to flow from the lower portion to the upper portion whilst having a flow velocity sufficiently low for allowing undesired particles in the water to participate by means of gravitation.

5. The device in accordance with claim 4, wherein the lower portion of the closed space is provided with an opening for allowing the inflow of untreated water directly into the closed space.

6. The device in accordance with claim 4, wherein the lower portion of the closed space is connected to a channel for allowing the inflow of untreated water directly into the closed space.

7. The device in accordance with claim 4, wherein the upper portion of the closed space is connected to a pump pipe for allowing discharge of cleaned water from the closed space.

8. The device in accordance with claim 4, wherein the closed space is located on a seabed.

9. The device in accordance with claim 4, wherein the closed space is defined by a seabed and a covering structure.

10. The device in accordance with claim 4, wherein the closed space is defined by a superstructure enclosing a wellhead on a seabed.

11. The device in accordance with claim 4, wherein the closed space is defined by a separate structure.

12. The device in accordance with claim 4, wherein the closed space is provided with an organism-repellent or toxic material for repelling, impairing or destroying undesired organisms in at least a part of the water.

* * * * *